US006895947B2

(12) United States Patent
Allmang et al.

(10) Patent No.: US 6,895,947 B2
(45) Date of Patent: May 24, 2005

(54) TURBOCHARGER

(75) Inventors: Rüdiger Allmang, Rheinlandpfalz (DE); Thomas Wittwer, Rheinlandpfalz (DE)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/668,744

(22) Filed: Sep. 22, 2003

(65) Prior Publication Data

US 2004/0055297 A1 Mar. 25, 2004

(30) Foreign Application Priority Data

Sep. 20, 2002 (EP) ..... 02021316

(51) Int. Cl.[7] ..... F02D 23/00

(52) U.S. Cl. ..... 123/559.3; 60/602; 60/801; 60/FOR 116; 415/160

(58) Field of Search ..... 60/602, 801, FOR 116; 123/559.3; 415/157, 158, 160

(56) References Cited

U.S. PATENT DOCUMENTS 3,972,644 A * 8/1976 Johnson ..... 415/163
4,490,622 A * 12/1984 Osborn ..... 60/602
5,146,752 A * 9/1992 Bruestle ..... 60/602
6,397,597 B1 * 6/2002 Gartner ..... 60/602
6,543,994 B2 * 4/2003 Jinnai ..... 415/160

* cited by examiner

*Primary Examiner*—Sheldon J Richter
(74) *Attorney, Agent, or Firm*—Pendorf & Cutliff; Greg Dziegielewski

(57) ABSTRACT

A turbocharger comprising at least one turbine wheel supplied with exhaust gas from a combustion motor. The amount of gas supplied is determined by a fluid control arrangement to which an actuation device is assigned for generating a controlling movement for the fluid control arrangement. In addition, a transmitting mechanism for this movement comprising an adjusting device is presented by which the control movement may be adjusted.

10 Claims, 3 Drawing Sheets

TURBOCHARGER

CROSS REFERENCE TO RELATED APPLICATION

This application is based upon European Patent Application No. 02 021 316.1, filed Sep. 20, 2002, from which priority is claimed.

FIELD OF THE INVENTION

The present invention relates to a turbocharger comprising a housing, at least one supply channel for supplying a fluid, generally exhaust gas from a combustion motor, into the housing and at least one turbine wheel accommodated in the housing so as to be driven about an axis of rotation by the fluid or gas. The invention also encompasses turbochargers having more than one turbine wheel and/or more than one supply channel, as is generally known in the art.

More particularly, the invention relates to a turbocharger featuring the above characteristics further comprising a fluid control arrangement for controlling the amount of gas supplied to the turbine wheel. To this fluid control arrangement, an actuation device is assigned for generating a controlling movement for the fluid control arrangement so as to vary the amount of fluid supplied to the turbine wheel, as well as a transmitting mechanism for transmitting the controlling movement of the actuation device to the fluid control arrangement.

It should also be noted that the term "fluid control arrangement" should be understood in its broadest sense, because such arrangements are known in the art in a variety of constructions. For example, documents JP-A-8-240156 or WO 02/27164 suggest a kind of controllable by-pass arrangement for by-passing more or less of exhaust gas around the turbocharger which is commonly called a "waste gate". However in many cases, a so-called guiding grid of variable geometry is used as a fluid control arrangement. The term "variable geometry" is understood in the art (see for example WO 01/96713) as an annular arrangement of pivoting guiding vanes that, according to their pivot position, open or close a series of nozzles or passages with a respective nozzle being formed between each pair of such vanes. Thus, the present invention is not restricted to one of these constructive principles, but should be applicable to all of them, although it is preferred to form the fluid control arrangement as a guiding grid of variable geometry. Of course, the invention also relates to a combination of both controlling principles.

BACKGROUND OF THE INVENTION

Turbochargers of the above-mentioned kind are known from the prior art, for example from WO 01/96713 and WO 02/27164, but also from EP 0 226 444 and U.S. Pat. Nos. 6,398,483; 5,692,879; 4,780,054; 3,972,644 or 2,860,827. In general, actuation devices used comprise a membrane in an actuator housing which is subjected to positive or negative pressure (in the context of the present specification when a "pressure" is mentioned, it should be understood to encompass either negative or positive pressure or both). The use of such a membrane is also one of the preferred embodiments of the present invention, although other actuation types, such as mechanical actuation or electromagnetic actuation, are also embodiments.

The above cited prior art all have their respective components specifically adapted to specific design criteria for the turbocharger they are designed for, and their components are also often specifically designed for a specific fluid control arrangement. Such designs are necessarily limited to the particular dimensions and parameters of the particular turbocharger. A modular approach for a specific turbocharger or fluid control arrangement for different applications is therefore not possible from the prior art. This contributes to production costs and reduces the possible number of pieces. On the other hand, it is impossible with the constructions of the prior art to realize different displacement forces (which are different in vehicles of different size and power) and/or different adjustment tolerances that are desirable in different applications.

SUMMARY OF THE INVENTION

It is an object of the present invention to provide a more flexible adaptation for different tasks and constructions, thus enlarging their field of application on the one hand, and to reduce their production costs on the other hand.

A further object is to provide the possibility of adaptation of a turbocharger construction to different requirements.

According to the invention these objects are achieved in that the transmitting mechanism comprises an adjusting device for altering the controlling movement of the actuation device.

In principle, the adjusting device can be designed very differently within the scope of the invention, but it is preferably a length adjusting device for adjusting the active or effective length of at least one member of the transmitting mechanism. This can, for example, be accomplished by adjusting the active length of a lever. For example, a lever may be slotted lengthwise, wherein the point of engagement of a further transmitting member can be adjusted with respect to the lever. It is preferred that the transmitting mechanism comprises a push-rod member extending along a longitudinal axis wherein the adjusting device is associated and effective. When altering the active length of a lever, i.e. a pivoting member, one generally changes both the origin and the end of the adjusting movement which is not always desired or requires additional measures, e.g. to provide an elastic stop, if a certain point of origin (or end) of the controlling movement should be kept.

Furthermore, it is also within the scope of the present invention to provide an automatic adjusting device, which could be used to adapt the construction for different temperature ranges in which operation occurs in different applications. For such an automatic adjusting device, an element that can expand as a function of temperature in the transmitting mechanism, as has been suggested for laser cavities, is also contemplated as one of the embodiments of the present invention. However, it is simpler and easier for the adaptation to different applications if the adjusting device comprises an adjusting element that is manually adjustable and can, be fixed in any position desired as necessary.

To meet the above-mentioned objectives of the invention, it is preferable to provide the transmitting mechanism with a displaceable push-rod member extending along a longitudinal axis and to assign the adjusting device to it so that the latter may be operatively connected to it. When designing the turbocharger in this manner, a space saving construction will be obtained if the actuation device comprises an actuator housing extending along an axis, and locating an actuator element in the actuator housing wherein the push-rod member extends from the actuator housing along its axis. Preferably, the push-rod member extends from the actuator element at one end up to a displacing member of the fluid control arrangement.

Of course, the adjusting device can be designed in different ways within the scope of the invention, for example by forming the push-rod member of two smooth rods which are more or less inserted into a sleeve and clamped, e.g. by fixing screws; or by screwing at least two parts of the push-rod into one another. However, a more stable design may be achieved if the push-rod member is formed by at least two parts extending along a longitudinal axis, one part receiving the other part in a cavity in an adjustable or fixable manner. In this way, the adjusting (and/or fixing) device can be accommodated within the cavity of the push-rod member. Moreover, interconnection can more easily be secured over a greater length. The adjusting device can then comprise at least one outer thread on one of the parts that is engaged by an inner thread of the other part wherein the thread allows for adjustment. In this way, the respective adjusted position can also be fixed by the thread, e.g. by providing one of the relative rotation preventing methods known in the art.

If, for example, the inner thread is formed as a nut rotatably supported on an associated push-rod part, the thread may be chosen so fine that there is virtually no risk of disadjustment after an adjustment has been effected. Nevertheless, any fixing means known in the art may be used, such as a lock nut.

Accommodating the adjusting device (and/or fixing device) in the interior of a cavity of the push-rod represents, of course, a special problem. This problem may be solved in that the push-rod may be formed of at least two parts extending along its longitudinal axis, these parts being rigidly interconnected to form the circumference of a closed cavity. It is preferred to form the push-rod of two circumferential parts only, which circumferential parts surround partially its longitudinal axis so that an adjusting or fixing device can easily introduced into the interior half cavity of one of the circumferential push-rod parts, before the cavity is closed by the complementary circumferential push-rod part. Interconnection of these circumferential parts may be effected in any way desired, for example by providing lateral flanges that could be screwed together. However, it is preferred if the circumferential push-rod parts, having introduced the adjusting and/or fixing device into the cavity, are welded together. Alternatively, the circumferential parts may be brazed though it is preferred if at least two circumferential parts are rigidly interconnected by a material connection free of connecting elements.

Another alternative could consist in that not only that axial part which is situated at the side of the fluid control arrangement, but also that other axial part which is at the side of the actuation device have a sleeve-like cavity closed by a sleeve cap having a cylindrical slip-on portion so that the sleeve cap, when slipped on the slip-on portion may be axially fixed to penetrate the cavity to a desired predetermined depth, e.g. by cooperating arresting members of the cavity and the slip-on portion.

The latter embodiment could be applied if the push-rod member is formed of at least two circumferential parts extending around its longitudinal axis, and which are rigidly interconnected to form and surround the substantially closed cavity, as explained above.

If the inner thread is formed as a nut rotatably held on one of the axial push-rod parts, another potential problem arises related to holding the nut in the cavity. It is preferable if the nut is rotatable at least in that part of the cavity formed by one of the circumferential push-rod parts in order to enable readjustment. However, then the question will arise as to how to secure the nut, at least in axial direction. This problem is conveniently solved within the scope of the present invention in that the cavity comprises a wall that extends transversely to the longitudinal axis for axially fixing the nut in the cavity. This wall may be a wall flange projecting into the interior of the cavity, but it is preferred if it is formed by at least one recess in the cavity wall. In this case, it would be conceivable to machine a recess into the cavity wall, thus forming a shoulder that fixes the nut in axial direction when the nut is in the recess. However, it is more advantageous if the recess is formed as a cut-out to define an opening and the nut projects partially into this opening and to the exterior. Thus, two advantages are achieved at the same time: first such an opening is easier to manufacture, and second is that the nut is accessible from the exterior so as to facilitate readjustment. Moreover, the nut is fixed within the cavity and cannot be lost.

A method describing how to interconnect the circumferential, cavity forming push-rod parts without welding or other firm connection has been explained above. However, for safety reasons, it is preferred that the push-rod be formed of the above-mentioned at least two circumferential push-rod parts extending around its longitudinal axis and to interconnect them firmly to form the cavity.

Such circumferential parts and such an interconnection are particularly easy to manufacture if the circumferential parts are formed in a cold-forming process from sheet metal. In principle, the present invention is not restricted to a certain cross-sectional shape of the push-rod, for this rod may have a square or oval cross-section, for example. However, it is preferred if the at least two circumferential parts, which extend around the longitudinal axis, form a cylindrical cavity, because in this way a maximum strength in all directions is achieved even with a relatively thin, and therefore light-weight, sheet metal.

BRIEF DESCRIPTION OF THE DRAWINGS

Further details of the invention will become apparent from the following description of a particularly preferred embodiment schematically illustrated in the drawings, in which:

FIGS. 2*a* and 2*b* each represent a perspective view of two circumferential parts of a push-rod according to the invention to be interconnected; of which FIG. 3 shows a longitudinal cross-section after interconnecting them; whereas

DETAILED DESCRIPTION OF THE DRAWINGS

Figure 1:
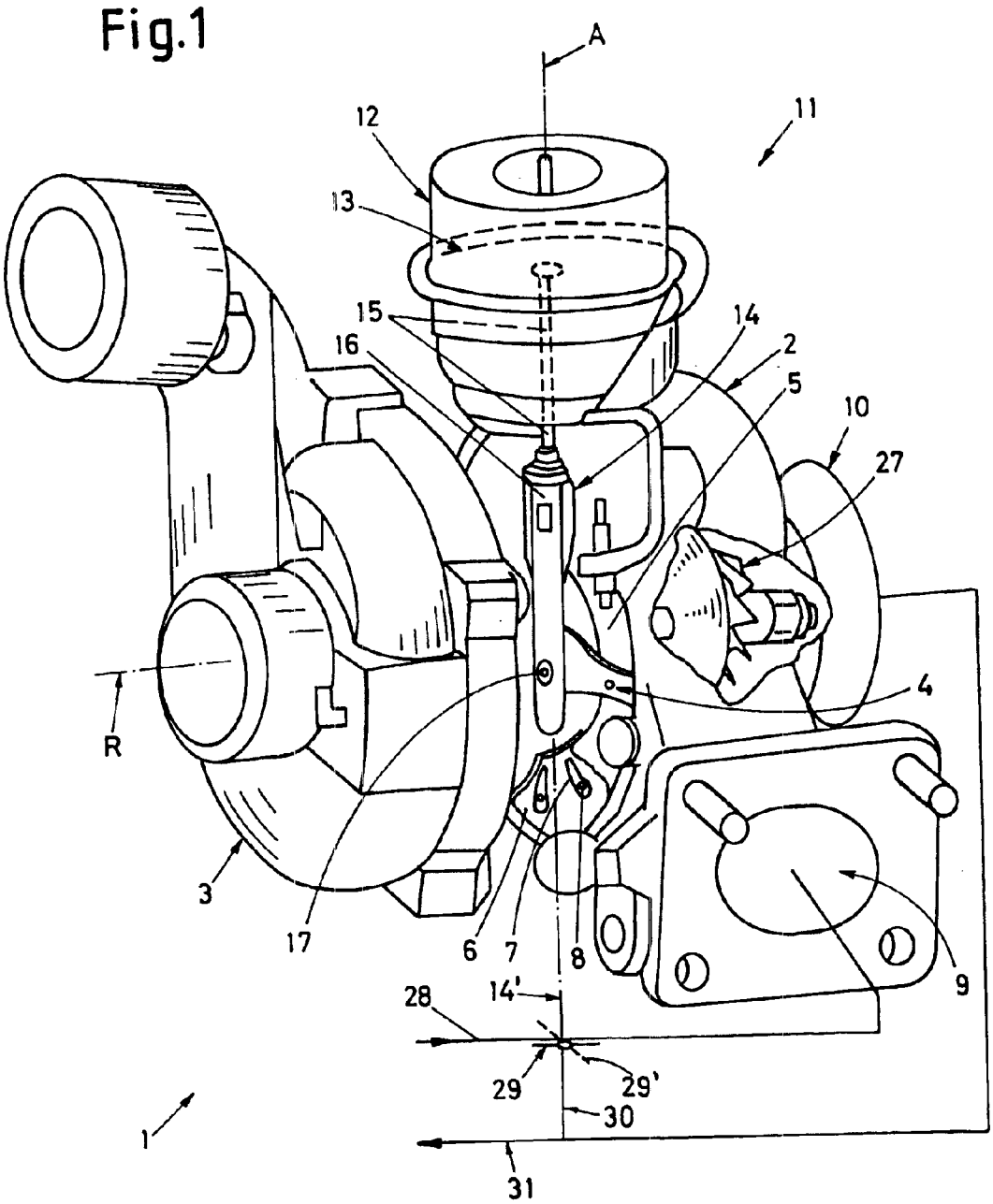
FIG. 1 shows a perspective view of a turbocharger according to the present invention, the parts being partially broken away to make the interior visible.

According to FIG. 1, a turbocharger comprises, as known (see the prior art cited above), a turbine housing part 2 and a compressor housing part 3 connected to the turbine housing part 2, both being arranged along an axis of rotation R. The turbine housing part 2 is partially broken away at the side facing the compressor housing part 3 so that a displacement lever 4 may be seen which displaces a unison ring 5 over a limited angle. Furthermore, a turbine wheel 27 may be seen to which exhaust gas from a combustion motor is supplied over a conduit 28 and a supply channel 9 that spirally surrounds the turbine wheel 27.

The amount of exhaust gas is controlled by a fluid control arrangement that, in the preferred embodiment, comprises a guiding grid of variable geometry. By pivoting the unison ring 5, guiding vanes 7 supported by a adjacent nozzle ring 6 (the lower portion of the unison ring 5 is broken away to make it visible) are pivoted each about its respective pivoting axis 8. In this way, each pair of adjacent vanes 7 form a nozzle cross-section between them which, in accordance with the pivoting position of the guiding vanes 7, i.e. more radial (as represented) or more tangential, is larger or smaller so as to control the flow of exhaust gas (or another fluid in the case of other turbines, such as a liquid) supplied by the supply channel 7 to the turbine wheel rotating about the axis R, the exhaust gas then being discharged over an axial or central pipe 10.

In order to control the movement and position of the guiding vanes 7 as well as the further fluid control arrangement shown in FIG. 1 and discussed later, an actuation device 11 is provided. This device may be of any nature, but it is preferred if it comprises an actuator housing 12, as is known, which extends along an axis A and comprises an actuator element in it, such as a plunger type magnet. In the present embodiment, however, the actuator element is a membrane 13 stretched between the two halves of the actuator housing as is also known. This membrane is biased by a positive or negative fluid pressure (generally air pressure) provided by an inlet connection (see the hole above in FIG. 1) in order to control and create a control movement of a push-rod member 14 fastened to the membrane 13. It is preferred if the longitudinal axis a (FIGS. 3, 4) of this push-rod member 14 is aligned with the axis A of the actuator housing 12 (although this is not necessarily the case) so that a direct transmission of the maximum flexion of the membrane 13 is effected to the other parts of a transmitting mechanism situated further below. This is space saving and safe and results in a reliable transmission of movement.

Figure 2B:
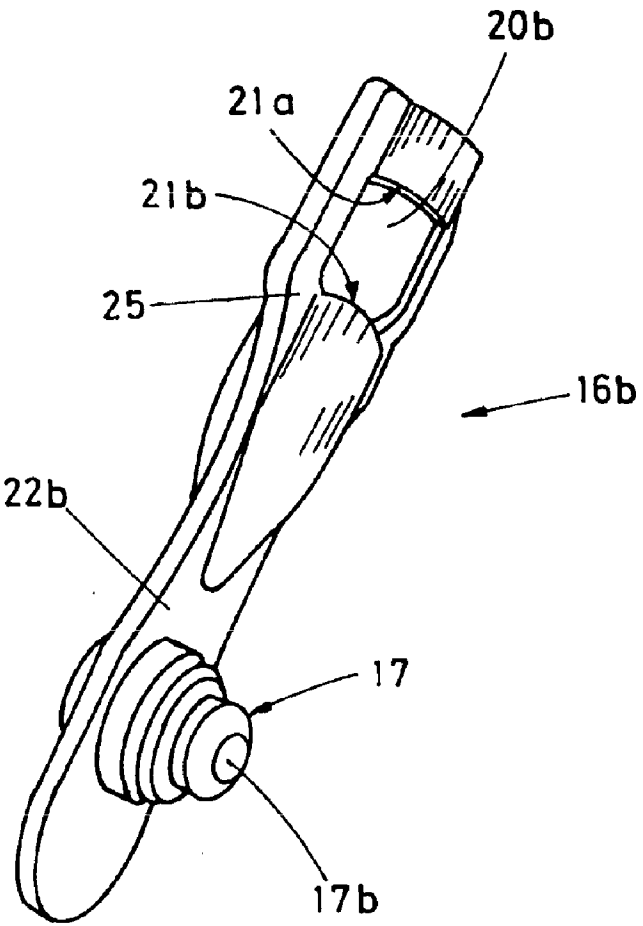
Figure 2A:
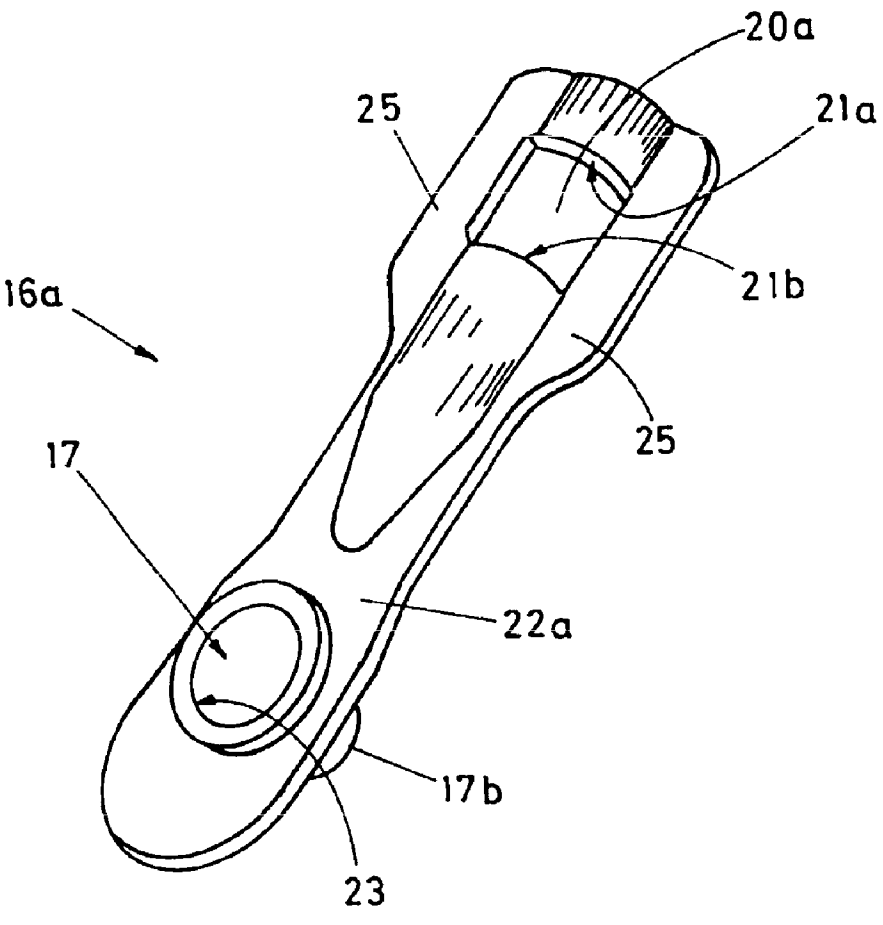
Figure 3:
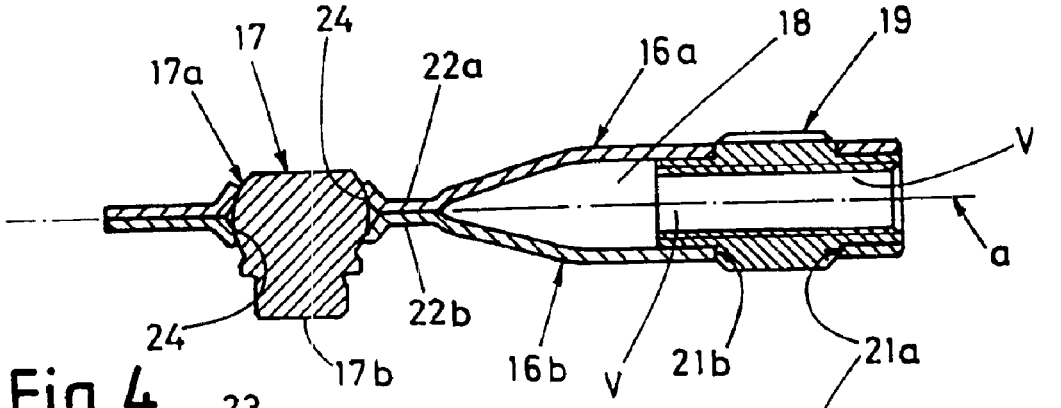
Figure 4:
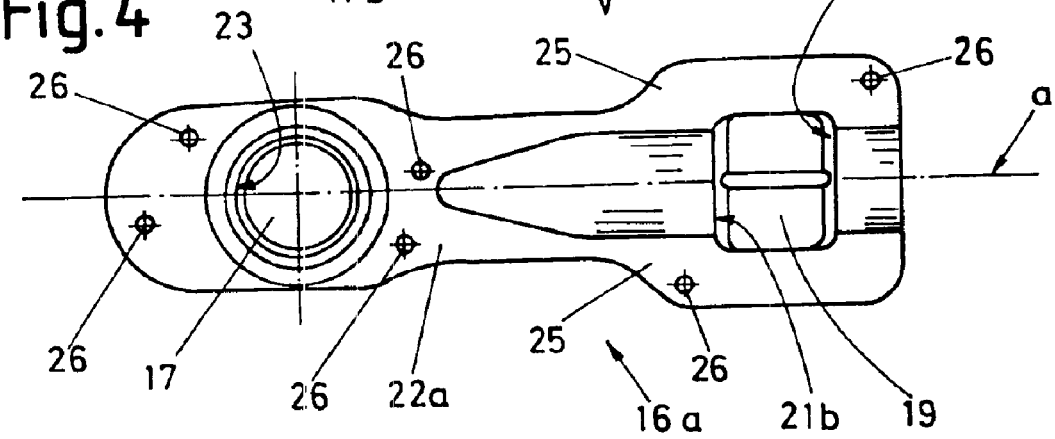
FIG. 4 illustrates a plan view to one of the circumferential parts.

The push-rod member 14 consists, as illustrated in FIG. 1, of a first axial part 15 connected directly to the membrane 13 and being provided with an outer thread, and a second axial part 16 which is provided with a corresponding inner thread (best seen in FIG. 3), whose shape is illustrated in detail in FIGS. 2 to 4 and which adjustably receives the first axial part 15 in its partially hollow interior for axial adjustment. At the lower end (with respect to FIG. 1) of the second axial push-rod part 16, there is a pivoting articulation or joint 17 by which the push-rod member 14 is operatively connected to a displacing lever 4 to transmit the controlling movement of the membrane 13 to this lever 4, and from it to the unison ring 5, and from this ring ultimately to the guiding vanes 7.

It should be noted at this point that, although adjustment is effected according to the preferred embodiment with a two-part push-rod member 14, that the present invention is neither restricted to two nor to the interconnection illustrated. It is, for example, conceivable to provide an adjustment by having a radial slot in the displacing lever 4 and to adjust the joint 17 within this slot. Moreover, adjustment could be effected either in addition to, or alternatively in the further course of, the transmission of movement to the guiding vanes 7. However, it is understood that not only is such an orientation less restrictive along the push-rod member 14, but that the accessibility (e.g. for readjustment, if necessary) is improved, and that the risk of disadjustment is smaller with a transmitting member which transmits displacement forces along its axis (a in FIGS. 3 and 4).

The set of guiding vanes 7 have been described above as a fluid control arrangement. In addition or (preferably) alternatively to these, the push-rod member 14 could be connected to a waste gate, which is a kind of by-pass valve 29 in conduit 28, as is indicated by dotted line 14'. This by-pass valve 29 may assume the position represented by heavy lines wherein the conduit 28 to the supply channel 9 is fully open, or a position 29' wherein at least part of the exhaust gas supplied by conduit 28 is deviated over a by-pass conduit 30 to an exhaust conduit 31. The amount or proportion of exhaust gas which is deviated to the conduit 31 depends on the position of the by-pass valve 29 (shown as a butterfly valve in this embodiment), which may be positioned very precisely by the actuation device 11. Instead of a butterfly valve, any kind of controllable valve or any deviating device desired may be used.

It has been mentioned above that various constructions of the push-rod member 14 are within the scope of the present invention. FIGS. 2 to 4 illustrate a preferred construction at least of the second, lower axial part 16 and a preferred design of an adjustment device, although the construction principle with two circumferential parts, as described below, could also be used for the push-rod member 14 not subdivided in axial direction into at least two axial parts.

According to FIGS. 2 to 4, the second axial push-rod part 16 may consist of two parts 16*a* and 16*b* to be interconnected (FIGS. 2*a*, 2*b*) which, when interconnected (FIG. 3) substantially surrounds the longitudinal axis a of the push-rod member 14 (or comprise this axis) and may, therefore, be called "circumferential parts" (in contrast to the first and second parts which are located subsequently one after the other in axial direction). The reason for sub-dividing the push-rod member into at least two circumferential parts will become apparent from the following description.

Both circumferential parts 16*a*, 16*b* are preferably stamped or pressed from sheet metal. They comprise a cavity 18, as best seen in FIG. 3, that is preferably approximately cylindrical, wherein an adjusting nut or threaded nut 19 is supported. In order to support this adjusting nut 19 in a predetermined and immovable axial position (with respect to the longitudinal axis a), the two circumferential parts 16*a*, 16*b* (or at least one of them) have a cut-out to define a window-like opening 20*a* and 20*b* through which a, preferably knurled, edge or rim of the adjusting nut projects to the exterior (FIG. 3), thus enabling easy adjustment from the exterior. Thus, this edge or rim of the adjusting nut 19 abuts the wall portions of the openings 20*a* and 20*b* in the direction of the longitudinal axis and is axially fixed. This is a particularly favorable embodiment that may easily be manufactured by stamping (or other cold forming processes) which, however, is not the only possible one.

It is also contemplated (when stamping the openings 20*a* and 20*b*) to bend their upper and lower edges at 21*a* and 21*b* a little bit to the interior towards the longitudinal axis a, thus providing a larger abutment surface for the threaded nut 19. However, this requires additional space and has as a consequence that the nut 19, when turned, is guided only by these peripheral flaps that, in general, will not be desired. Moreover, it is also contemplated, as indicated in FIG. 4, to form the circumferential parts 16*a*, 16*b* of solid material and, optionally, without the window-like openings 20*a*, 20*b* and to machine transversely to the longitudinal axis a extending wall sections 21*a*, 21*b* out of the material. In this case, however, production would be more complicated, readjustment would become more difficult, and the weight of the push-rod member would also be increased which renders response to controlling movement of the membrane 13 (FIG. 1) slower.

When comparing FIGS. 3 and 4, it is clear that the adjusting nut itself could be formed in different ways. For instance, FIG. 3 illustrates that a piece V can be seen joining the knurled portion. Although this piece V could be the first axial push-rod part 15 (FIG. 1) screwed into the nut 19, it could also be a prolongation of the threaded portion of the nut 19 so as to achieve a more stiff and stable guidance of the first axial part 15 whose outer thread is screwed into the inner thread of the nut 19. In this way, more friction will result which prevents undesirable disadjustment.

Of course, it is difficult to support the joint 17 within a cylinder forming the cavity 18 (FIG. 3). Therefore, it is preferred that the circumferential parts 16*a*, 16*b* comprise an at least partially flat, interengaging connection portion 22*a* and 22*b* which not only serves for a rigid interconnection of the two circumferential parts 16*a*, 16*b*, but it also enables easy attachment of the joint 17.

Preferably, this joint 17 comprises a spherical body 17*a* to enable movement in more than one direction relative to the displacement lever 4. Attached to this spherical body 17*a* is a swivel journal 17*b* either rigidly connected to the body 17 or even integrally formed with it. In order to ensure a reliable bearing for the spherical body 17*a*, in spite of the flat shape of the connection portions 22*a*, 22*b* of the two circumferential parts 16*a*, 16*b*, particularly favorable for interconnection, the corresponding bearing opening 23 (FIGS. 2, 4) for receiving the joint 17 is defined according to FIG. 3 by spherical wall portions 24 which hold the spherical body 17*a* firmly, but in an easily pivoting manner. However, such a spherical construction will only be desirable in some cases, for in many applications a simple cylindrical pin may serve as an articulation body.

It is also preferable that the connection portions 22*a* and 22*b* are prolonged by a seam 25 (FIGS. 1, 2 4) at the side of the cavity 18 so that interconnection of the circumferential parts 16*a*, 16*b* is possible over a greater axial length. For example, the two circumferential parts 16*a*, 16*b* could be interconnected at connection places 26 by rivets or screws. However, it is preferred to connect them by a connection free of such connection elements, such as by brazing or, most favorably, by welding, such as spot welding, e.g. laser welding, etc.

It is to be understood that even more than two circumferential parts could be provided which each surround only a sector of the cavity 18, but this is, in general, not desired, because strength might be affected. It has already been mentioned that other interconnection and adjustment designs for the at least two axial push-rod parts 15, 16 are conceivable, for example forming them as a kind of cylindrical sleeve wherein a sleeve cap is inserted. Furthermore, more than two axial push-rod parts could be provided to have several adjustment facilities, but in general a single adjustment facility will be sufficient, and by using only two parts 15, 16 following to one another in axial direction the greatest strength and stability will be obtained.

What is claimed is:

1. A turbocharger (1) including:

a turbine wheel (27) supplied with exhaust gas from an internal combustion engine via at least one supply channel (9), wherein the amount of supplied exhaust gas is controllable via a gas control device (4, 7, 11, 29), which is associated with an actuating device (11) for producing a control movement to be transmitted to the gas control device (4, 7, 11, 29), as well as a transmission device (4, 5, 14, 15, 16) for transmitting the control movement of the actuating device (11) to the gas control device (4, 7, 11, 29);

wherein the transmission device (4, 5, 14, 15, 16) includes an adjusting device (15, 19; V) for adjusting the control movement;

wherein the transmission device (4, 5, 14, 15 16) includes an abutment element (14) which is moveable along a longitudinal axis (a), against which the adjustment device (15, 19; V) engages;

wherein the abutment element (14) is comprised of a first part on the actuating element side and a second part lying along the gas control device (4, 7, 11, 29) and wherein a) the fixing device (19) includes at least one internal threading (19) of the second part (16 or 15) for receiving the external threading of the first part (15 or 16), via which the adjustment occurs, b) wherein the internal threading (19) is a threaded nut mounted (19) rotatable on an associated abutment piece (16), c) which is rotatably mounted in the hollow space (18) of the abutment piece (16) and in its axial position is axially located by at least one wall segment (21*a*, 21*b*) extending perpendicular to the longitudinal axis (a) of the abutment piece (16), d) which is formed by at least one wall recess (20*a*, 20*b*) in the hollow space (18) of the abutment piece (16), and e) wherein the wall recess (20*a*, 20*b*) has a through-hole whereby a part of the circumference of the threaded nut (19) projects outwards for adjustment.

2. The turbocharger (1) according to claim 1, further including at least one of the following characteristics:

a) the adjusting device (15, 19; V) is a length adjusting device for adjusting the effective length of at least one element (14) of the transmission device (4, 5, 14, 15, 16);

b) the adjusting device (15, 19; V) includes a manually operated and fixable adjusting element (19; V).

3. The turbocharger (1) according to claim 1 wherein the transmission device (4, 5, 14, 15 16) includes an abutment element (14) which is moveable along a longitudinal axis (a), against which the adjustment device (15, 19; V) engages.

4. The turbocharger (1) according to claim 3, further including at least one of the following features:

a) the gas control device (4, 7, 11, 29) includes a guide array (7) of variable turbine geometry and is connected with this guide array (7) via at least one adjusting lever (4), wherein the adjusting lever (4) is adjustable by the actuating element (11) via the abutment element (14);

b) the actuating element (11) includes a control housing (12) extending along an axis (A) with an actuating element incorporated therein (13), and the abutment element extends out of the control housing (11) approximately along this axis (A), from the actuating element (11) on its end to a adjustment device (4) of the gas control device (7, 29) on the other end;

c) the actuating element (11) includes an actuating membrane operable via a positive or negative pressure.

5. A turbocharger (1) including:

a turbine wheel (27) supplied with exhaust gas from an internal combustion engine via at least one supply channel (9), wherein the amount of supplied exhaust gas is controllable via a gas control device (4, 7, 11, 29), which is associated with an actuating device (11) for producing a control movement to be transmitted to the gas control device (4, 7, 11, 29), as well as a transmission device (4, 5, 14, 15, 16) for transmitting the control movement of the actuating device (11) to the gas control device (4, 7, 11, 29);

wherein the transmission device (4, 5, 14, 15, 16) includes an adjusting device (15, 19; v) for adjusting the control movement;

wherein the transmission device (4, 5, 14, 15 16) includes an abutment element (14) which is moveable along a longitudinal axis (a), against which the adjustment device (15, 19; V) engages; and wherein the abutment element (14) is comprised of a first part on the actuating element side and a second part lying along the gas control device (4, 7, 11, 29), of which the first part (15 or 16) receives the second part (16 or 15) in a hollow space (18) adjustable and fixable via a fixing device (19).

6. The turbocharger (1) according to claim 5, wherein a) the fixing device (19) includes at least one internal threading (19) of the second part (16 or 15) for receiving the external threading of the first part (15 or 16), via which the adjustment occurs, b) the internal threading (19) is a threaded nut mounted rotatable on an associated abutment piece (16), c) which are rotatably mounted in the hollow space (18) of the abutment piece (16) and in their axial position are axially located by at least one wall segment (21*a*, 21*b*) extending perpendicular to the longitudinal axis (a) of the abutment piece (16), d) which is formed by at least one wall recess (20*a*, 20*b*) in the hollow space (18) of the abutment piece (16), e) wherein the wall recess (20*a*, 20*b*) in certain cases for forming an opening has a through-hole whereby a part of the circumference of the threaded nut (19) projects outwards for adjustment.

7. A turbocharger (1) including:

a turbine wheel (27) supplied with exhaust gas from an internal combustion engine via at least one supply channel (9), wherein the amount of supplied exhaust gas is controllable via a gas control device (4, 7, 11, 29), which is associated with an actuating device (11) for producing a control movement to be transmitted to the as control device (4, 7, 11, 29), as well as a transmission device (4, 5, 14, 15, 16) for transmission the control movement of the actuating device (11) to the gas control device (4, 7, 11, 29);

wherein the transmission device (4, 5, 14, 15, 16) includes an adjusting device (15, 19; V) for adjusting the control movement;

wherein the transmission device (4, 5, 14, 15 16) includes an abutment element (14) which is moveable along a longitudinal axis (a), against which the adjustment device (15, 19; V) engages; and wherein the abutment element (14) is comprised of at least two circumferenced parts (16*a*, 16*b*) extending about its longitudinal axis (a), which are rigidly connected with each other to form an essentially closed hollow space (18).

8. The turbocharger (1) according to claim 7, further including at least one of the following characteristics:

a) the at least two circumferenced parts (16*a*, 16*b*) extending around a longitudinal axis (a) are press or punch parts;

b) the at least two circumferenced parts (16*a*, 16*b*) extending around a longitudinal axis (a) together form a cylindrical shape;

c) the at least two circumferenced parts (16*a*, 16*b*) are connected with each other by a material connection (26) free of connecting parts and are welded to each other.

9. The turbocharger (1) according to claim 7 wherein the hollow space (18) faces the actuating element (11) against which the actuating device (11) opposing end of the abutment element (14) is connected with an adjustment element (4) of the gas control device (4, 7, 11, 29).

10. The turbocharger (1) according to claim 9 wherein the at least two circumferenced parts (16*a*, 16*b*) extending about the longitudinal axis (a) in the connection to the hollow space (18) include an at least partially flat surface lying against connecting segment (22*a*, 22*b*), wherein the connecting segment (22*a*, 22*b*) includes an opening (23) bordered by a spherically-shaped wall segment (24) for bearing a bearing body such as an arc shaped body (17*a*) with a thereto rigidly connected pivot pin (17*b*) for transmission of the movement of the abutment element (14) upon a control element (4) of the gas control device (4, 7, 11, 29)

or wherein the connecting segment (22*a*, 22*b*) continues with a seam (25) on the side of the hollow space (18).

* * * * *